United States Patent [19]

Weishalla

[11] Patent Number: 4,930,330

[45] Date of Patent: Jun. 5, 1990

[54] DOUBLE ACTION BOTTOM FORMER

[75] Inventor: Gale Weishalla, Maple Grove, Minn.

[73] Assignee: Pride Machine Inc., Fridley, Minn.

[21] Appl. No.: 386,296

[22] Filed: Jul. 27, 1989

[51] Int. Cl.[5] ..... B21D 22/30; B21D 22/00

[52] U.S. Cl. ..... 72/348; 72/453.13

[58] Field of Search ..... 72/347-349, 72/453.13

[56] References Cited

U.S. PATENT DOCUMENTS

| | | | |
|---|---|---|---|
| 3,402,591 | 9/1968 | Maeder | 72/345 |
| 3,593,552 | 7/1971 | Fraze | 72/347 |
| 3,610,018 | 10/1971 | Swanson et al. | 72/348 |
| 3,771,345 | 11/1973 | Paramonoff | 72/349 |
| 3,812,696 | 5/1974 | Kneusel et al. | 72/354 |
| 3,951,083 | 4/1976 | Hortig | 72/348 |
| 4,289,014 | 9/1981 | Maeder et al. | 72/348 |
| 4,304,038 | 12/1981 | Yabu et al. | 29/458 |
| 4,372,143 | 2/1983 | Elert et al. | 72/347 |
| 4,620,434 | 11/1986 | Pulciano et al. | 72/347 |
| 4,669,298 | 6/1987 | Kono et al. | 72/348 |
| 4,722,215 | 2/1988 | Taube et al. | 72/349 |
| 4,733,550 | 3/1988 | Williams | 72/348 |

FOREIGN PATENT DOCUMENTS

| | | | |
|---|---|---|---|
| 692656 | 10/1976 | U.S.S.R. | 72/347 |
| 1082521 | 3/1984 | U.S.S.R. | 72/347 |

*Primary Examiner*—Robert L. Spruill

*Attorney, Agent, or Firm*—Merchant, Gould, Smith, Edell, Welter & Schmidt

[57] ABSTRACT

A method and structure for a piston suspension system for tooling used during shaping of a metal can blank. An integral cylinder housing member is provided with two cylindrical opposing chambers having different diameters. Axial bores are located in sidewalls of a first chamber to receive pushrods extending into the second chamber. A piston is provided in the second chamber for tensioning support of the pushrods. Resilient members are arranged to provide tensioning support for the integral cylinder housing member substantially independent of the piston member and the pushrods.

27 Claims, 6 Drawing Sheets

DOUBLE ACTION BOTTOM FORMER

TECHNICAL FIELD OF THE INVENTION

The present invention relates generally to a suspension system for a machine to shape can blanks and more particularly to a piston suspension system for tooling used during bottom forming of a metal can blank.

BACKGROUND OF THE INVENTION

Within the field of metal can manufacturing, requirements exist to shape the bottom portions of cans. Due to the nature of drawn cans and their contents, the bottom must be formed accurately to provide the required strength. Processes for manufacturing drawn cans include draw and iron machines which generally include a ram-like member for moving a metal can blank into contact with a bottom former machine. Normally, a tool set shapes the desired can bottom shape. The tool set is installed into the bottom former machine. In operation, the draw and iron machine ram pushes the ram-mounted metal can blank against the tool set to form the can bottom. The bottom former machine provides tension to the tool set to hold the tool set in proper position, to form the bottom when impacted with the can material, to cushion the impact of the metal against the tool set, and to return the tool set to its initial position when the drawn and iron press ram withdraws.

As manufacturing processes for making drawn cans have evolved, output demands have steadily grown. At present, can makers searching for equipment that can withstand high production rates of cans per minute are frequently not satisfied with the capabilities of bottom former machines. A principle problem resides in manufacturing a bottom former which is capable of withstanding high can throughput without breakdown or damage.

What has been needed, therefore, has been an improved bottom former for use in shaping a metal can at can cycle rates of greater than 250 cans per minute. What has been further needed has been an improved bottom former for shaping metal cans at a can cycle rate of approximately 300 cans per minute or greater.

What has been further needed has been an improved bottom former to provide excellent tool set tensioning and long life during high cycle rate bottom forming operations.

What has been further needed has been an improved bottom former which employs a double-action principle for tensioning bottom forming doming action with a first tensioning means and for tensioning bottom forming ring action with a second tensioning means during high throughput bottom forming operations.

What has been even further needed has been an improved bottom former employing a double action tensioning system for tensioning the force of metal can blanks contacting associated portions of the bottom former and which provides tensioning for the ring action using automotive style piston means.

What has been even further needed has been a bottom former using a double action tensioning system which includes an automotive style piston for tensioning ring action and which uses a cylinder body in cooperation with resilient spring means for tensioning the doming action of a metal can blank contacting tool set means placed in the bottom former to provide high throughput bottom forming operations.

Other objects and advantages of the invention will appear from the following detailed description which, in connection with the accompanying drawings, discloses embodiments of the invention for purposes of illustration only and not for determination of the limits of the invention.

SUMMARY OF THE INVENTION

A method and structure is provided for a piston suspension system for tooling used during shaping of a metal can blank. An integral cylinder housing member is provided with two cylindrical opposing chambers having different diameters. Axial bores are located in sidewalls of a first chamber to receive pushrods extending into the second chamber. A piston is provided in the second chamber for tensioning support of the pushrods. Resilient members are arranged to provide tensioning support for the integral cylinder housing member substantially independent of the piston member and the pushrods.

DETAILED DESCRIPTION OF THE INVENTION

As required, detailed embodiments of the present invention are disclosed herein. It is to be understood, however, that the disclosed embodiments are merely exemplary of the invention which may be embodied in various forms. Therefore, specific structural and functional details disclosed herein are not to be interpreted as limiting, but rather as a basis for teaching one skilled in the art to variously employ the present invention in virtually any appropriately detailed system or structure.

Figure 1:
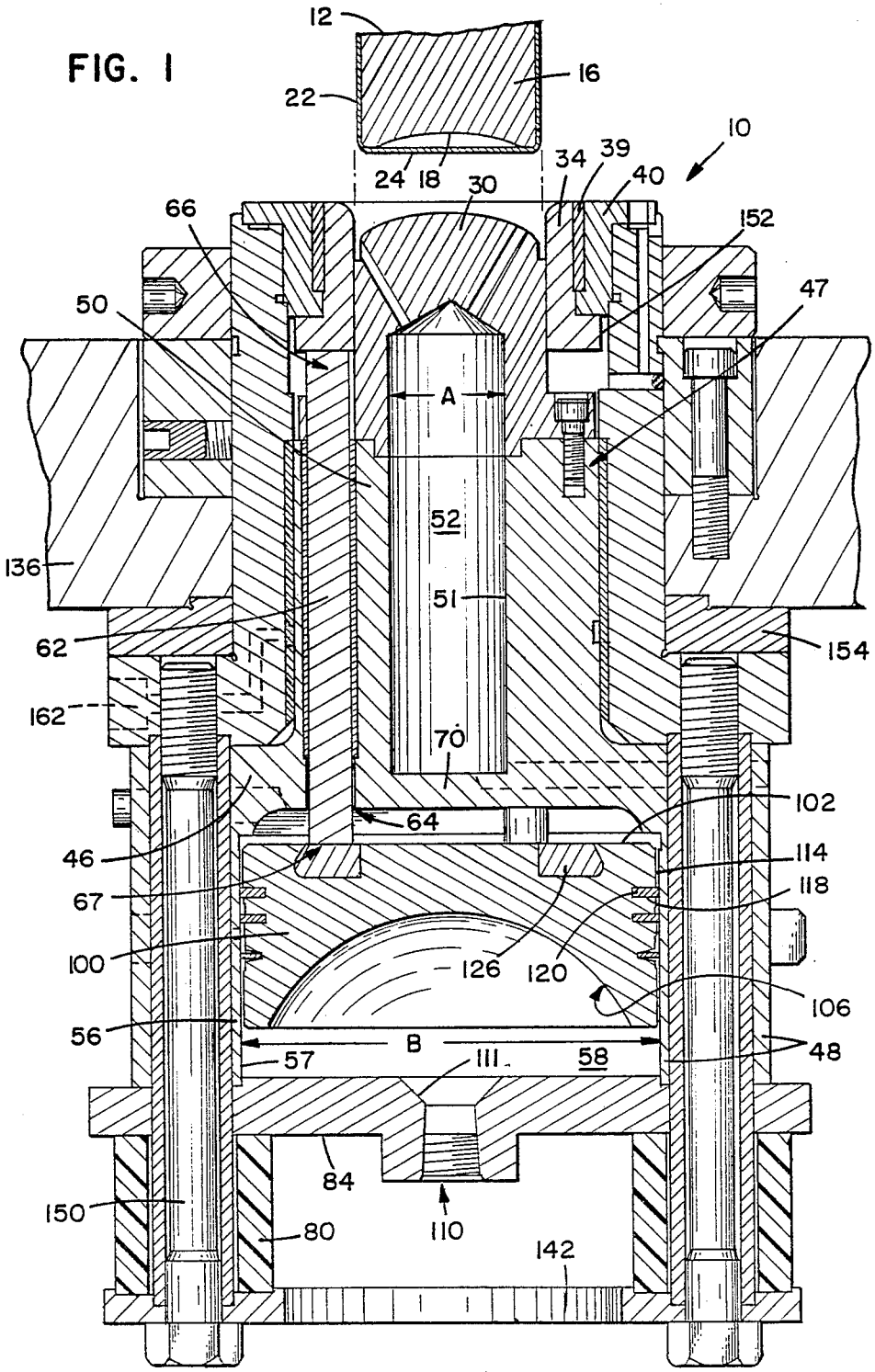
FIG. 1 is a side elevational cross section view of a bottom former positioned for receipt of a can blank mounted on a draw and iron press arm.

Referring to FIG. 1, a bottom former 10 for shaping metal container bottoms according to the present invention is shown. Although bottom formers generally are well known in the art of metal can manufacturing, bottom former 10 comprises structure and method of operation heretofore unknown. As will be later shown, bottom former 10 comprises means for tensioning and suspension advantageous for high throughput metal can forming operations. As illustrated, bottom former 10 is constructed and arranged for operation in association with a drawn and iron machine. Drawn and iron machines are also well known in the field and generally cooperate with bottom forming portions of metal can shaping machines through means of a ram-like member, such as press arm 12 shown in the present application. It is understood that press arm 12 forms no part of the present invention but is displayed to show the cooperation between bottom former 10 and drawn and iron means of associated equipment. More particularly, press arm 12 typically comprises a ram member 16 which may have variously shaped press end portions 18, such as generally concave shaped press end portion 18 shown herein. Draw and iron means press arm 12 is constructed and arranged to hold a metal can blank 22 and to move metal can blank 22 into contact with portions of a bottom former machine, such as bottom former 10. Thus, press arm 12 moves metal can blank 22 into contact with tool set means located on an opposing portion of a bottom former. This contact between metal can blank 22 and bottom former 10 results in shaping of metal can blank 22 bottom portion 24 into desired shapes. As may be appreciated due to the variety of bottom shapes on cans throughout economies served by bottom former 10, tool set means may vary widely in the shapes which are achieved with their use. In other words, interchangeability of tool set means to provide various bottom portions of metal can blanks is desirable and is considered inherent in the bottom former 10 capabilities, although this feature is not the principle object of the present invention.

The variety of differently shaped tool set means referred to above may be represented herein by the tool set means generally designated throughout this application. It is acknowledged that alternately shaped tool set means may be employed within the spirit of this invention. A preferred tool set means utilized with bottom former 10 comprises a dome former 30, ring former 34, and various components forming mounting assembly parts. Such components may comprise, for example, guide bushing 39, clamp ring retainer 40, and associated attachment means for providing attachment to adjacent portions of dome former 30 and bottom former 10. Preferably, dome former 30 and ring former 34 are not attached to each other and are arranged for relative independent movement. For example, as shown in FIG. 1, ring former 34 is positioned radially around dome former 30, and push ring 39 and clamp ring 40 cooperate to retain ring former 34 in position relative to dome former 10. Ring former 34 and dome former 30 are substantially independently movable relative to one another. This feature will be discussed in greater detail later in this specification.

Within the field of machines for shaping metal containers, such as cans, numerous problems exist. A particularly formidable problem relates to the inability of prior art devices to provide sufficient tensioning or suspension for tool set means during high throughput bottom shaping operations. The structure of the present invention provides means for solving this problem by use of a novel double action piston suspension system. In particular, a piston suspension system for tooling used during shaping of a metal can blank is provided. This system, and associated method, makes use of theory and design concepts more commonly associated with heretofore unrelated automotive piston design and operation. As will be discussed in detail, the present bottom former 10 invention utilizes a double action tension or suspension system employing biasing means for tensioning the force acting on dome former 30 while substantially simultaneously employing an automotive style air piston for operably tensioning the force acting against ring former 34. Thus, a novel combination of parts is provided to achieve high throughput and reliable operation of bottom former 10.

Referring again to FIG. 1, bottom former 10 comprises an integral cylinder housing member 46. Integral cylinder housing member 46 comprises a first end portion 47 and a second end portion 48. Integral cylinder housing member 46 preferably is shaped as an elongate object with chambers of certain diameters at each end, and with the chambers substantially separated by an integral member therebetween located within integral cylinder housing member 46. Preferred integral cylinder housing member 46 first end portion 47 comprises sidewalls 50 having inner surfaces 51 defining a first axial chamber 52. Although first axial chamber 52 may comprise various shapes, a preferred shape comprises a cylindrical shape having a diameter denoted by length A as shown in FIG. 1. Similarly, integral cylinder housing member 46 second end portion 48 comprises sidewalls 56 having inner surfaces 57 defining a second axial chamber 58. Second axial chamber 58 preferably is of a substantially cylindrical shape having a diameter denoted by length B as shown in FIG. 1. In order to best achieve the efficiencies of the present invention, diameter B of second axial chamber 58 is greater than diameter A of first axial chamber 52.

This relative relationship of diameter B to diameter A permits use of pushrod means extending from contact with a portion of ring former 34 axially through first end portion sidewalls 50 and into contact with a tensioning member located within second axial chamber 58. More particularly, preferred pushrod means comprises at least one and preferably a plurality of pushrods 62 slidably positioned within axially oriented sidewall bores 64 of integral cylinder housing member 46 first end portion sidewalls 50. Each pushrod 62 comprises a first end 66 and a second end 67. First end 66 of each pushrod is constructed and arranged for subjacent contact with a portion of ring former 34, while each pushrod second end 67 is constructed and arranged for normal contact on the top of a tensioning member movably located within second axial chamber 58. Each pushrod 62 is designed to receive and transfer the force of a metal can blank moving in contact with ring former 34. Thus, the force of the contact between the metal and ring former 34, which causes axial movement of ring former 34 within bottom former 10, is transferred by pushrods 62 to a tensioning member located within second axial chamber 58. Accordingly, the material of each pushrod 62 must be high strength and should be substantially non-deformable in use. Each of preferred pushrods 62 comprise cylindrically shaped pushrods manufactured of high strength metal.

As discussed above, pushrod means are provided for transferring force from ring former 34. However, additional transfer of force from dome former 30 is recommended for proper operation of bottom former 10 as well. Dome formers are generally located as shown in relation to integral cylinder housing member 46 first end portion 47. Preferred dome former 30 directly abuts first end portion 47 so that when metal can blank 22 contacts dome former 30, the force of the contact is transferred to integral cylinder housing member 46 at first end portion 47. As illustrated in FIG. 1, integral cylinder housing member 46 is designed so that axial movement of first end portion 47 resulting from the axial movement of mounted dome former 30 produces corresponding axial movement of second end portion 48.

In order to provide tensioning for dome former 30, biasing means is provided proximate integral cylinder housing member 46 second end portion 48. Although various configurations of biasing means may be provided, a preferred biasing means comprises spring means such as resilient urethane springs 80 arranged to operatively bias components of bottom former 10 axially toward the tool set means or more generally toward the opposing force of a metal shaping draw and iron press arm. In a preferred embodiment, resilient urethane springs 80 are configured to operatively bias a second axial chamber cover plate 84 which abuts integral cylinder housing member second end portion 48 sidewalls 56. Therefore, the biasing means provides tensioning and opposing force against axial movement of integral cylinder housing member 46 toward the biasing means.

In order to achieve high throughput operation, bottom former 10 must provide means for tensioning as well as re-positioning the components which are contacted by metal can blank 22. This invention provides novel piston suspension means for this purpose. In particular, piston means are provided for providing suspension for the pushrod means to allow rapid axial movement of pushrod means and associated components. This is a principal feature which has not heretofore been adequately integrated into a bottom former machine. Piston means of the present invention preferably comprises a piston member 100 arranged to provide tensioning for each pushrod 62. Piston member 100 is preferably movably positioned within integral cylinder housing member second axial chamber 58. Various shapes of piston member 100 may be employed. Preferred piston member 100 comprises a contact surface 102 facing integral chamber separator 70, the contact surface providing contact with each second end 67 of each pushrod 62. Piston member 100 also preferably comprises receiving surface 106 as shown in FIG. 1 which faces cover plate 84.

To achieve maximum efficiency and durability, mechanical linkage for operating piston member 100, such as a rod or the like, has been eliminated in favor of a pressurized medium mode of operation. In other words, a pressurized medium, such as a high pressure gas, is routed into contact with receiving surface 106 to force piston member 100 toward integral chamber separator 70. FIG. 1 illustrates receiving surface 106 in the shape of a concave receiving surface to best accommodate the dispersion characteristics of a pressurized medium entering second axial chamber 58 through access means in cover plate 84. In this embodiment, access means comprises an aperture 110 formed by aperture wall surfaces 111 centrally located within cover plate 84. The central point relation of aperture 110 as the source of a pressurized medium entering second axial chamber 58 encourages use of concave receiving surface 106 to ensure equal force acting against all parts of receiving surface 106. Other relations of pressurized medium access means to second axial chamber 58 may be employed within the scope of this invention.

Piston member 100 also comprises sidewalls 114 extending between contact surface 102 and receiving surface 106. Sidewalls 114 may further comprise ring grooves 118 constructed and arranged for receipt of pressure retaining piston rings 120 therein. As further illustrated in FIG. 1, preferred embodiment piston member 100 comprises a planar contact surface 102 although such planarity is only particularly necessary where pushrod second ends 67 contacts piston member 100, and is dependent on the shape of second axial chamber 58. However, as shown in FIG. 1, piston member 100 has planar contact surface 102 with an annular ring insert 126 constructed and arranged for contact with second end portion 67 of each pushrod 62. Preferred annular ring insert 126 comprises material that is hardened to withstand the contact and tensioning force transferred from and to each pushrod 62. A variety of materials may be selected for use as a hardened annular ring insert 126, however, the requirement of hardness must also be tempered by a desire for relatively lightweight material to enhance the efficiency of piston member 100 during operation. Accordingly, piston member 100 may be constructed of a material selected from the group consisting of aluminum, titanium, carbide, ferro-bonded carbide, and combinations thereof. Indeed, the requirement for a hardened annular ring insert may be eliminated depending on the choice of material and characteristics of piston member 100. Use of a hardened steel annular ring insert 126 with an aluminum piston member 100 has yielded excellent efficiencies and durability during operational testing.

Other features of bottom former 10 shown in FIG. 1 are provided according to this invention. Such other features include outer housing means 136 including various subassemblies for holding and retaining integral cylinder housing member 46. A spring end plate 142 is arranged in abutting relation with a biasing means and also provides anchor means for tension bolts 150. Tension bolts 150 serve principally to connect the various components of bottom former 10 between spring end plate 142 and integral cylinder housing member first end portion 47. Preferred bottom former 10 may comprise circumferentially located high stress tension bolts 150 as well as circumferentially located resilient urethane springs 80. Also, secondary drain 152 is provided to prevent hydraulic effect at the tool set means. A split spacer 154 may also be provided in bottom former 10.

Figure 2:
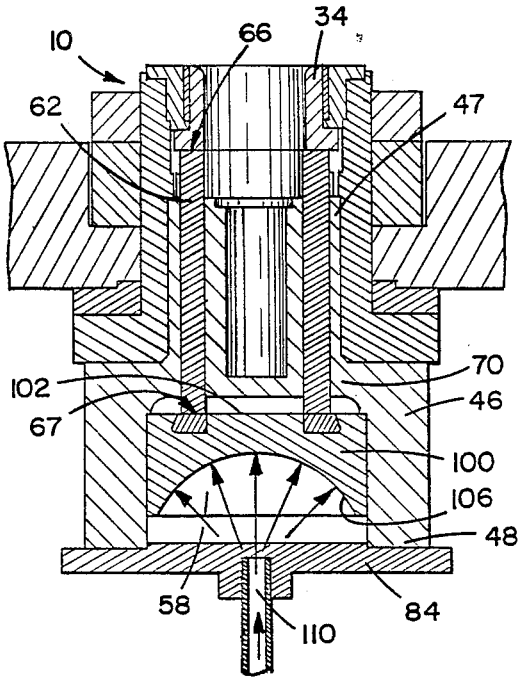
FIG. 2 is a side elevational cross section view of a double action bottom former ring tensioning subsystem.
Figure 3:
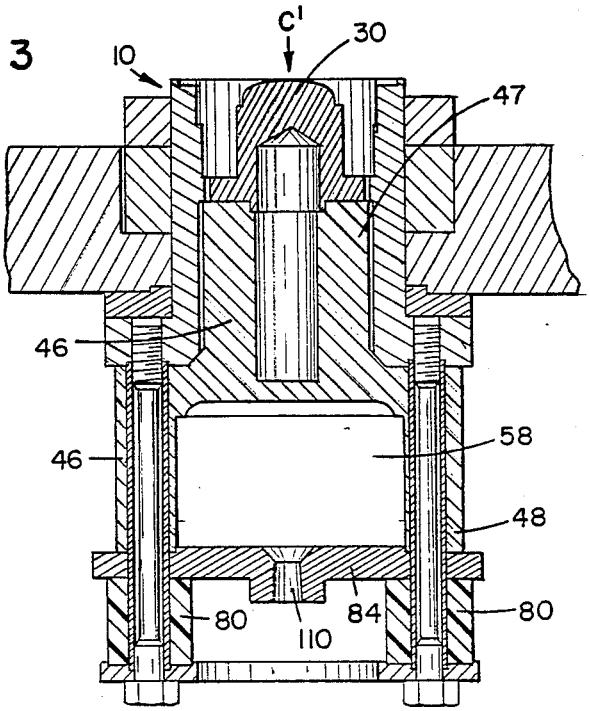
FIG. 3 is a side elevational cross section view of a double action bottom former dome tensioning subsystem.

FIGS. 2 and 3 illustrate by subsystem the double action principal which is utilized in this novel design of bottom former 10. In FIG. 2, the operation of a ring former tensioning subsystem is revealed. In particular, FIG. 2 illustrates the abutting relationship between ring former 34 and each pushrod 62 first end 66. As forces are applied against ring former 34 in the direction of force line C (by metal being pressed against ring former 34), the forces are transmitted to pushrods 62 which then move axially in the direction of piston member 100. As the pushrods move axially in the direction of force line C, each pushrod 62 second end 67 applies force against piston member 100 in the direction of force line C as well. In order to provide tensioning for the force being exerted against ring former 34 and piston rods 62, piston member 100 comprises receiving surface 106 which receives a pressurized medium thereagainst. A suitable pressurized medium may include pressurized gas, such as high pressure air, which is routed into second axial chamber 58 and which applies force against receiving surface 106 to urge piston member 100 toward integral chamber separator 70. In other words, the force of a pressurized medium, shown in FIG. 2 by the exemplary vectors positioned against receiving surface 106, creates an air suspension effect for piston member 100 to provide tensioning support for each pushrod 62 and ring former 34. This subsystem comprising an air piston suspension technique permits rapid repositioning of each piston rod 62 in response to the demands for high throughput operation of metal shaping machines using bottom forming mechanisms. When this subsystem is combined with the dome former subsystem discussed in relation to FIG. 3, the compound effect of the two tensioning subsystems creates a highly efficient mechanism. Indeed, some measure of the efficiency may be noted by the proven throughput rates of bottom former 10 exceeding 250 cans per minute. The dome former tensioning subsystem disclosed in FIG. 2 need not use an extremely high pressurized medium in order to function efficiently. Although many variables determine the pressure required of a pressurized medium acting against receiving surface 106, a proven pressurized medium for high throughput metal can shaping operations includes air at a pressure of 80 pounds per square inch.

Referring now to FIG. 3, the dome former tension subsystem is illustrated. In preferred bottom former 10, dome former 30 is located in abutting relationship with first end portion 47 of integral cylinder housing member 46. When force that is represented by force vector C' is applied against dome former 30, as during metal can forming operations, dome former 30 is moved axially within bottom former 10. The axial movement of dome former 30 causes corresponding axial movement of integral cylinder housing member 46 as well. In order to provide tensioning support for this movement and to provide means for returning dome former 30 to its original position, biasing means are provided. As discussed herein above, biasing means may comprise spring means such as preferred resilient urethane springs 80 and cover plate 84. As shown in FIG. 3, the combination of the resilient urethane springs biasing cover plate 84 against integral cylinder housing member 46 second end portion 48 provides tensioning support for dome former 30. The load capability or strength of biasing means used in dome former 10 depends on design choice, however, resilient urethane springs having a rating of approximately 600 lbs have been found to be acceptable for the particular embodiment disclosed in FIGS. 1, 2, and 3. It is understood that various biasing means may be utilized comprising any of various load ratings. A piston suspension system according to this invention may successfully utilize a dome former subsystem comprising a preload suspension of between about 2700 lbs and about 6000 lbs.

The novel combination of tensioning subsystems disclosed in this invention provides a compounding effect of the pressures in each subsystem to permit shorter stroke lengths, or axial movement, of the ring former 34 and the dome former 30 within this double action bottom former 10. In a preferred embodiment, the piston suspension system permits maximum axial movement of the ring former 34 when contacted by a metal can blank of about 0.45 inch (1.143 cm). Similarly, in a preferred embodiment, the maximum axial movement of the dome former 30 when contacted by a metal can blank is about 0.008 inch (0.02032 cm). Thus, the several advantages of the present invention include a combination or compounding effect of pressures to permit shorter stroke lengths of individual components or subsystems to further enhance the economic operation of preferred bottom former 10. This in itself is an improvement over prior art devices which generally require longer stroke lengths and therefore longer repositioning times.

Figure 4:
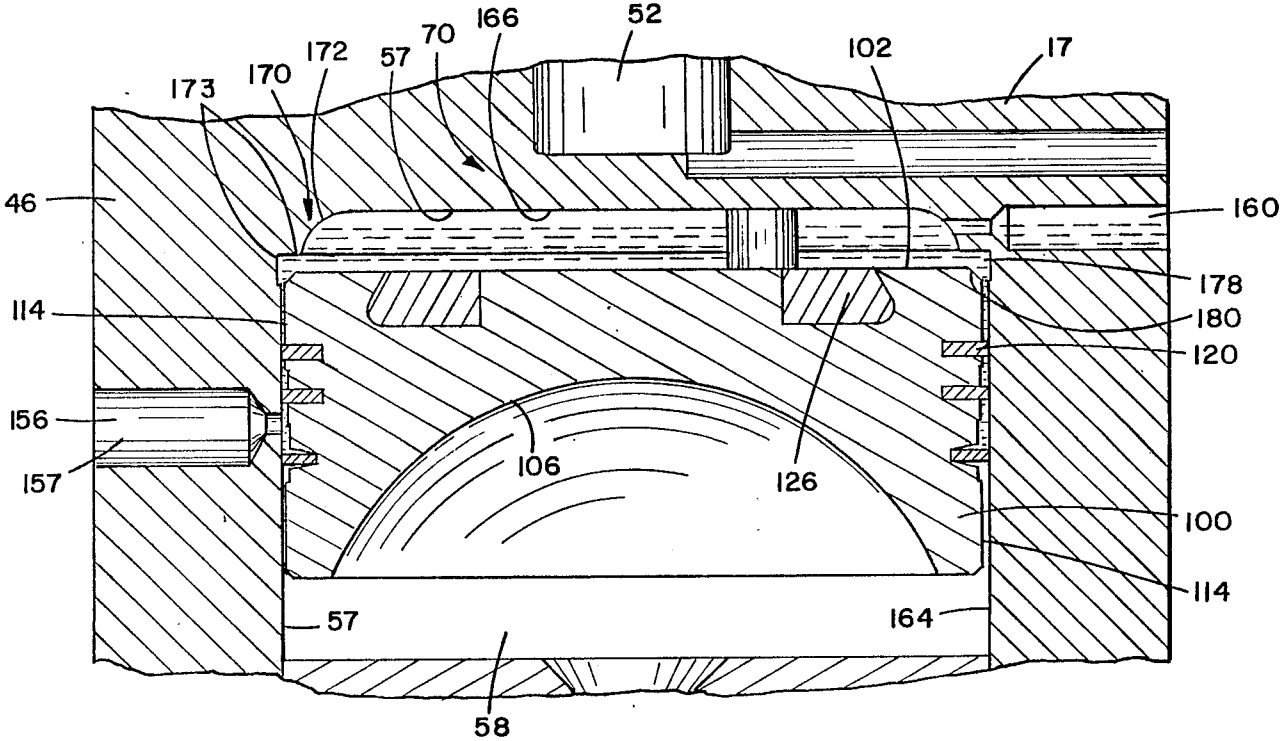
FIG. 4 is a side cross section fragmentary view of piston means within an integral cylinder housing member second axial chamber, oil inlet and drain means, and a debris evacuation bore.

The forces involved in high throughput metal shaping operations described herein require exceptionally durable component parts. Therefore, preferred integral cylinder housing member 46 comprises a cast iron material and more preferably a pearlitic cast iron material in keeping with the durable automotive concept for good wear characteristics. Positive wear characteristics of double action bottom former 10 are also enhanced by a unique provision of metered and level controlled oiling. Referring to FIG. 4, a side cross-sectional portion of bottom former 10 is shown including exemplary oil inlet and drain means. More particularly, an oil inlet bore 156 is manufactured having sidewalls extending through integral cylinder housing member 46 second end portion sidewalls which define second axial chamber 58. Oil inlet bore 156 may comprise various internal diameters to enhance metering effects of lubricating oil or other fluids passed therethrough from a source external of integral cylinder housing member 46, through bore 156, and into second axial chamber 58. In operation, a lubricating oil 157 is passed through oil inlet bore 156 and into contact with piston member sidewalls 114 so that the axial movement of piston member 100 within second axial chamber 58 is facilitated. In a preferred embodiment of double action bottom former 10, oil inlet bore 156 is constructed and arranged for allowing lubricating oil or other appropriate lubricating medium to enter second axial chamber 58 within a distance of the maximum axial stroke lengths of piston rings 120 circumferentially located about piston member 100. This preferred construction promotes the most efficient functioning of piston member 100 and tends to prohibit migration of any lubricating oil into contact with a high pressure medium acting against receiving surface 106. Moreover, such placement of oil inlet bore 156 in cooperation with piston member 100 encourages movement of excess or waste oil toward contact surface 102 of piston member 100. This migration of waste oil through action of piston member 100 and placement of oil inlet bore 156 allows efficient removal of said oil and other lubricating oil through oil drain bore 160 carefully positioned adjacent integral chamber separator 70 as shown in FIG. 4. Oil drain bore 160 comprises sidewalls extending through integral cylinder housing member 46 second end portion sidewalls 56 about second axial chamber 58. In accordance with the present invention, more than one oil drain bore 160 and, possibly, oil inlet bore 156, may be utilized. In FIG. 4, exemplary lubricating oil 157 is shown in broken lines along piston member sidewalls 114 between piston rings 120, and between piston member contact surface 102 and the end of second axial chamber 58 formed by integral chamber separator 70. It is understood that atomized as well as liquid forms of lubricating oil will probably be present. Metering and timing means, which are not shown, may be operably utilized in association with oil inlet and drain means to provide a metered oil supply to lubricate double action bottom former 10. Also, FIG. 1 illustrates an exemplary grease path 162 for routing lubricating grease to bushings associated with each pushrod 62. Pinhole accesses then permit the grease to lubricate the pushrods.

Referring again to FIG. 4, piston member 100 antilock means is shown which comprises structure on piston member 100 and shape and structure of second end portion sidewalls 56 inner surfaces 57. In particular, a piston suspension system according to this invention comprises second axial chamber sidewalls comprising inner surfaces 57 having a circumferential and axially oriented inner sidewall surface 164 constructed and arranged for operatively guiding axial movement of piston member 100 so that piston member sidewalls 114 remain in substantially parallel relation with second axial chamber circumferential and axially oriented inner sidewall surface 164. Second axial chamber sidewalls inner surfaces 57 also comprise a forward end surface 166 formed substantially by integral chamber separator 70. Corner surfaces 170 are also provided extending between circumferential and axially oriented inner sidewall surface 164 and forward end surface 166. Corner surfaces 170 provide important antilock structure within second axial chamber 58. Corner surfaces 170 in preferred bottom former 10 comprise a curved segment 172 and a plurality of linear segments 173. Linear segments 173 form a piston lock prevention groove 178 extending radially into the circumferential and axially oriented inner sidewall surface 164 so that piston member 100 contact surface 102 and piston member sidewall surfaces 114 will move toward and away from second axial chamber forward end surface 166 independent of any friction locking at corner surface 170. Piston member 100 may comprise chamfered surfaces in order to further enhance the sensitivity and response of piston member 100 within second axial chamber 58. For example, a chamfered surface 180 may be optimally located circumferentially about and forming the intersection of piston member contact surface 102 and piston member sidewalls 114. A preferred angle of approximately 45° relative to both the contact surface 102 and sidewall surfaces 114 has been used effectively for chamfered surface 180.

Figure 5:
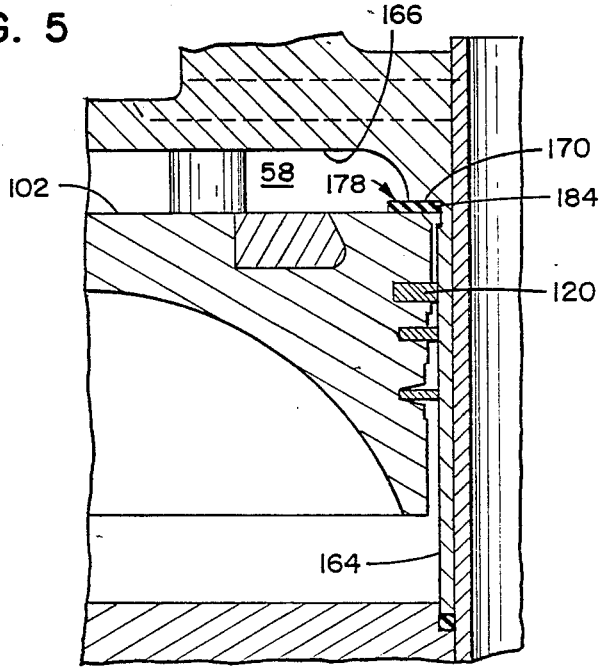
FIG. 5 is a side cross section fragmentary view of a portion of the second axial chamber illustrating piston member sidewall ring grooves, pressure retaining piston rings, and a second axial chamber circumferential bumper.

Referring to FIG. 5, an optional circumferential bumper 184 is shown located in piston lock prevention groove 178 and extending beyond the plane of circumferential and axially oriented inner sidewall surface 164 into the path of movement of piston member 100. Thus, circumferential bumper 184 provides shock mitigation for piston member 100 and second axial chamber corner surfaces 170. Although circumferential bumper 184 may comprise various materials, a preferred circumferential bumper 184 comprises durable urethane material.

Figure 6:
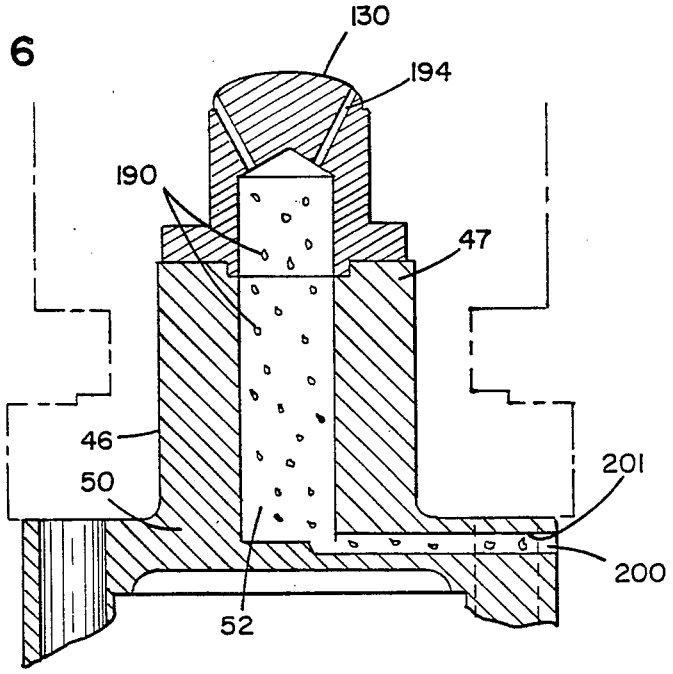
FIG. 6 is a side cross section fragmentary view of the first axial chamber debris evacuation subsystem.

Yet another problem exists with respect to the physical effects of a metal can blank 22 contacting tool set means associated with a bottom forming machine. One problem relates to metal debris caused by the force of contact between the various components and the drawing or stretching of the metal during the shaping process. As illustrated in FIG. 6, debris 190 may be readily removed from the portions of tool set means which contact and shape the metal by means of routing apertures 194 formed by portions of dome former 130. Routing apertures 194 permit debris 190 to travel into first axial chamber 52. A debris evacuation bore 200 is also preferably provided. Debris evacuation bore 200 comprises sidewalls 201 extending substantially radially through a section of cylinder housing member first end portion sidewalls 50 into first axial chamber 52 to provide an evacuation path for debris 190 and for pressurized air or coolant medium from within first axial chamber 52. Suction means may augment the above debris removal structure but is usually not a requirement for suitable debris evacuation.

Figure 7:
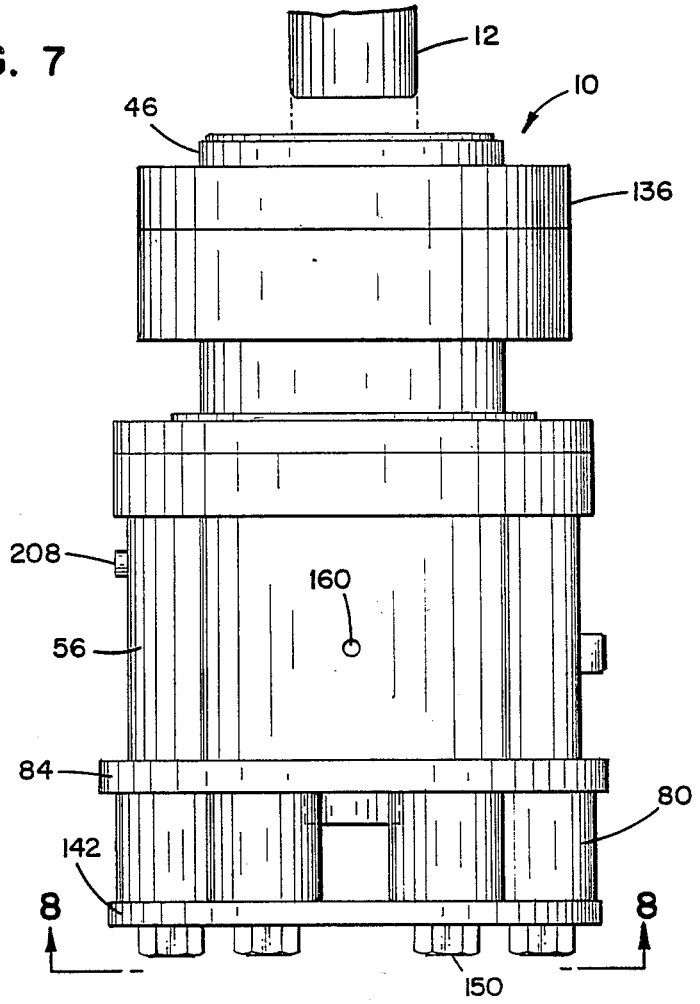
FIG. 7 is a side elevation environmental view of a double action bottom former and a drawn and iron press ram.

A side elevational view of preferred double action bottom former 10 is shown in FIG. 7 in association with a representative press arm 12 extending toward bottom former 10. Outer housing means 136, which may be in the form of a fixed outer housing, is shown located substantially around the portion of integral cylinder housing member 46 comprising first axial chamber 52. Outer housing means 136 provides for mounting of bottom former 10 and acts as a reference for axial movement of components of bottom former 10. Integral cylinder housing member 46 may also include air breather means 208, which may be optionally employed with oil inlet bore 156, and an oil drain bore 160. Second axial chamber cover plate 84 is shown adjacent to biasing means in the form of spring means shown as resilient urethane springs 80. A spring end plate 142 provides means for connecting and anchoring various components of double action bottom former 10. The means for connecting these components also includes tension bolts 150.

Figure 8:
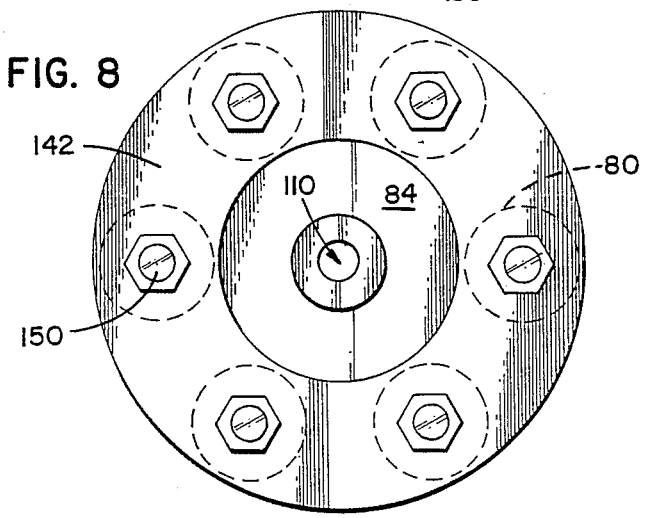
FIG. 8 is an end view of the double action bottom former of FIG. 7.

FIG. 8 is an end view, corresponding to FIG. 7, showing tension bolts 150 assembled against spring end plate 142 and arranged for axial placement through resilient spring means 80. Spring end plate 142 is of an annular shape in the preferred embodiment and thus permits ready access to pressurized medium source means aperture 110 and second axial chamber 58.

Figure 9:
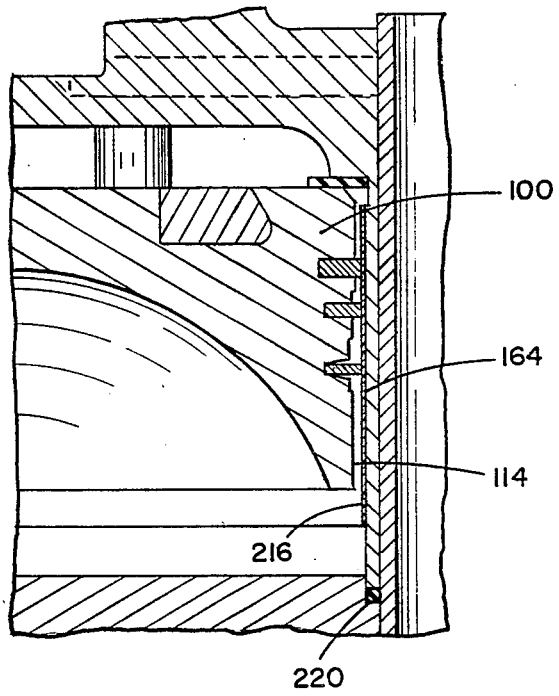
FIG. 9 is a side cross section fragmentary view of a double action bottom former second axial chamber comprising a circumferential inner sleeve insert.

FIG. 9 is an enlarged side sectional view of a portion of bottom former 10 second axial chamber 58. In the embodiment shown in FIG. 9, second axial chamber 58 comprises a circumferential inner sleeve insert 216 which is provided to reduce any metal-to-metal friction wear between piston member 100 and second axial chamber circumferential and axially oriented sidewalls 164. It is understood that various configurations of materials may be utilized within second axial chamber 58 to achieve strengths and efficiencies appropriate for individual operations of bottom former 10. For example, a lighter weight piston requires less force and mass on other parts and helps to increase the speed of the piston member 100. Similarly, a circumferential inner sleeve insert 216 made of high strength but lightweight material may contribute substantially to the wear characteristics of bottom former 10. Indeed, a spray-on coating may also be used on circumferential and axially oriented sidewalls 164 to achieve some benefits realized otherwise by a circumferential inner sleeve insert of a more rigid and material shape. It is understood also that such modifications may be applied to piston member sidewalls 114 as well. FIG. 9 also discloses an optional o-ring air seal 220 located between second axial chamber cover plate 84 and integral cylinder housing member second end sidewalls 56.

Thus, what is shown and claimed in this invention is a piston suspension system for tooling used during shaping of a metal can blank comprising an integral cylinder housing member 46 having first and second end portions. The first end portion 47 comprises sidewalls 50. The second end portion 48 comprises a cylinder with sidewalls 56 defining a second axial chamber 58. A cover plate 84 is arranged across second axial chamber 58. Integral cylinder housing member first end portion sidewalls 50 comprise at least one and preferably a plurality of axially oriented bores 64 extending from integral cylinder housing member first end portion 47 into second axial chamber 58. Pushrod means comprising a pushrod 62 having a first end 66 and a second end 67 are arranged within each bore 64. Pushrod means are provided to transfer energy from near first end portion 47 of integral cylinder housing member 46 to a tensioning member within second axial chamber 58. The tensioning member comprises piston means movably positioned within second axial chamber 58. Preferred piston means comprises a piston member 100 comprising a contact surface 102 facing and in contact with pushrod second end 67 of each pushrod 62. A preferred piston member 100 also comprises a receiving surface 106 for receiving a pressurized medium supplied to second axial chamber 58 preferably through cover plate 84. In operation, a pressurized medium is applied to receiving surface 106 of piston member 100 to move piston member 100 axially within second axial chamber 58 in response to and in opposition to force applied against each pushrod 62 during metal forming operations. Auxiliary tensioning means in the form of biasing means is also provided to bias integral cylinder housing member 46 when said member is also axially moved by metal shaping forces. The compound effect of the pressurized medium acting on piston member 100 and the preload suspension of the spring biasing means provides an improved performance double action bottom former 10 suitable for high throughput metal can forming operations.

A piston suspension system for tooling used during shaping of a metal can blank may also be described as comprising an integral cylinder housing member 46 having a first end portion 47 and a second end portion 48, the first end portion comprising an elongate cylinder with sidewalls 50 defining a first axial chamber 52 with a first diameter A. The second end portion 48 preferably comprises a cylinder with sidewalls 56 defining a second axial chamber 58 with a second diameter B which is larger than the first diameter A. The first and second axial chambers are separated by an integral chamber separator 70. In other words, integral cylinder housing member 46 is machined from a single piece of material creating a strengthened member integral thereto which serves to substantially separate the first and second axial chambers. The second axial chamber 58 comprises a cover plate 84 arranged across the diameter B. Further, integral cylinder housing member first end portion sidewalls 50 comprise a plurality of axially oriented bores 64 extending from integral cylinder housing member first end portion 47 through integral chamber separator 70 and into second axial chamber 58. Pushrod means are provided preferably comprising a plurality of pushrods 62 which are each slidably positioned within an axially oriented bore 64 of integral cylinder housing member first end portion sidewalls 50 and integral chamber separator 70. Each of pushrods 62 comprise a first end 66 and a second end 67. Biasing means are provided for operatively biasing cover plate 84. Tool set means are located at the first end portion 47 of integral cylinder housing member 46 and comprise a ring former 34 and a dome former 30 for contacting and shaping a metal can blank pressed against the tool set means. Ring former 34 is preferably located radially around dome former 30 and is in abutting engagement with first end 66 of each pushrod 62. Piston means is provided to afford tensioning and suspension of the pushrod means, and comprises a piston member 100 movably positioned within integral cylinder housing member second axial chamber 58. Piston member 100 preferably comprises a contact surface 102 facing integral chamber separator 70. Contact surface 102 provides a contact surface for second end 67 of each pushrod 62 which extends through integral chamber separator 70. Preferred contact surface 102 faces integral chamber separator 70. Piston member 100 also comprises a receiving surface 106 facing cover plate 84 for receiving a pressured medium thereagainst. Access means are provided to permit a pressurized medium into second axial chamber 58 to provide force against piston member receiving surface 106 so that as a metal can blank is forced into contact with the tool set means the force of that contact is transferred through dual action of the ring former 134 axially by the pushrod means to piston member 100 and by the dome former 130 substantially axially through integral cylinder housing member 46 to biased cover plate 84.

A method is also provided according to the present invention for absorbing the mechanical shock of a metal shaping machine during high speed and high throughput manufacture comprising the steps of providing an integral cylinder housing member with first end portion bores and slidable pushrods therein and a second end portion comprising an axial chamber with a cover plate; configuring piston means within the axial chamber to provide suspension for the pushrods and routing a pressurized medium against the surface of the piston member to provide pushing force; and operatively biasing the cover plate so that it provides a biasing force against a portion of the integral cylinder housing member.

A method for absorbing the mechanical shock of a metal shaping machine during high speed and high throughput manufacture may also comprise a first step of providing an integral cylinder housing member having first and second end portions. The first end portion comprising an elongate cylinder with sidewalls defining a first axial chamber with a first diameter, and a second end portion comprising a cylinder with sidewalls defining a second axial chamber with a second diameter larger than the first diameter. The first and second axial chambers are preferably separated by an integral chamber separator. The integral cylinder housing member first end portion sidewalls preferably comprise a plurality of axially oriented bores extending from the cylinder housing member first end portion through the integral chamber separator into the second axial chamber. The next step comprises inserting a plurality of slidable pushrods into the integral cylinder housing member first end portion sidewall bores, each of the pushrods having a first end and a second end. The next step comprises mounting tool set means at the integral cylinder housing member first end portion with the tool set means comprising a ring former and a dome former for contacting and shaping a metal can blank. Preferably, the ring former is radially located around the dome former and is in abutting engagement with the first end of each of the pushrods. Next it is desirable to configure piston means to provide suspension for the pushrods. Piston means preferably comprises a piston member movably positioned within the integral cylinder housing member second axial chamber. The piston member preferably comprises a contact surface facing the integral chamber separator for contact with the second end of each of the pushrods extending through the integral chamber separator and a receiving surface facing away from the integral chamber separator and substantially opposite the contact surface. The receiving surface is preferably constructed and arranged to receive a pressurized medium thereagainst. Next, a cover plate is arranged across the diameter of the second axial chamber and in cooperation with adjacent biasing means is operatively biased axially against the integral cylinder housing member second end portion sidewalls. Finally, by routing a pressurized medium into the second axial chamber a force is provided against the piston member receiving surface so that as a metal can blank is forced into contact with the tool set means the force of that contact is transferred through dual action of the ring former axially by the pushrods to the piston member and by the dome former substantially axially through the integral cylinder housing member sidewalls to the biased cover plate to permit high throughput metal shaping manufacture.

The invention accordingly consists in the features of the construction, combinations of elements, arrangements of parts, and methods of manufacture which will be exemplified in the construction and methods described above and of which the scope of the invention would be indicated in the following claims. It is to be understood that while certain embodiments of the present invention have been illustrated and described, the invention is not to be limited to the specific forms or arrangements of parts herein described and shown.

WHAT IS CLAIMED IS:

1. A piston suspension system for tooling used during shaping of a metal can blank, comprising:

(a) an integral cylinder housing member having a first end portion and a second end portion, the second end portion comprising a cylinder with sidewalls defining an axial chamber, the first end portion comprising sidewalls having a plurality of axially oriented bores extending the length of the integral cylinder housing member first end portion and into the second end portion axial chamber;

(b) pushrod means comprising a plurality of pushrods slidably positioned within the first end portion sidewall bores;

(c) tool set means located at the integral cylinder housing member first end portion for contacting and shaping a metal can blank and for transferring the force of that contact to the pushrod means;

(d) piston means for providing suspension for the pushrod means comprising a piston member movably positioned within the integral cylinder housing member second end portion axial chamber, the piston member comprising a contact surface constructed and arranged for contact with the pushrod means extending into the second end portion axial chamber and a receiving surface substantially opposite the contact surface for receiving a pressurized medium so that as a metal can blank is forced into contact with the tool set means the force of that contact is transferred axially by the pushrod means to the piston member and so that the piston means provides repositioning means for axial repositioning of the pushrod means and the tool set means.

2. A piston suspension system according to claim 1 wherein the second end portion axial chamber is cylindrically shaped and comprises a biased cover plate arranged across the diameter of the axial chamber, the cover plate being biased against the integral cylinder housing member in the direction of the integral cylinder housing member first end portion to provide secondary axial suspension means in association with the piston means.

3. A piston suspension system according to claim 2 wherein the biased cover plate comprises a circular cover plate having a first surface abutting the integral cylinder housing member and a second surface opposite the first surface abutting resilient spring biasing means.

4. A piston suspension system according to claim 1 wherein the integral cylinder housing member comprises pearlitic cast iron material.

5. A piston suspension system according to claim 1 wherein the piston member is constructed of a material selected from the group consisting of aluminum, titanium, carbide, ferro-bonded carbide, and combinations thereof.

6. A piston suspension system for tooling used during shaping of a metal can blank, comprising:

(a) an integral cylinder housing member having first and second end portions, the first end portion comprising an elongate cylinder with sidewalls defining a first axial chamber with a first diameter, the second end portion comprising a cylinder with sidewalls defining a second axial chamber with a second diameter larger than the first diameter, the first and second axial chambers being separated by an integral chamber separator, the second axial chamber having a cover plate arranged across the diameter of the second axial chamber, the integral cylinder housing member first end portion sidewalls comprising a plurality of axially oriented bores extending from the integral cylinder housing member first end portion through the integral chamber separator into the second axial chamber;

(b) pushrod means comprising a plurality of pushrods slidably positioned within the axially oriented bores of the integral cylinder housing member first end portion sidewalls and the integral chamber separator, each of the pushrods having a first end and a second end;

(c) biasing means for operatively biasing the cover plate;

(d) tool set means located at the integral cylinder housing member first end portion comprising a ring former and a dome former for contacting and shaping a metal can blank, the ring former radially located around the dome former and in abutting engagement with the first end of each of the pushrods;

(e) piston means for providing suspension for the pushrod means comprising a piston member movably positioned within the integral cylinder housing member second axial chamber, the piston member comprising a contact surface facing the integral chamber separator for contact with the second end of each of the pushrods extending through the integral chamber separator and a receiving surface facing the cover plate for receiving a pressurized medium; and (f) access means for providing a pressurized medium into the second axial chamber to provide force against the piston member receiving surface so that as a metal can blank is forced into contact with the tool set means the force of that contact is transferred through dual action of the ring former axially by the pushrod means to the piston member and by the dome former substantially axially through the integral cylinder housing member to the biased cover plate.

7. A piston suspension system according to claim 6 wherein the integral cylinder housing member is constructed of a material selected from the group consisting of pearlitic cast iron, aluminum, and steel.

8. A piston suspension system according to claim 6 wherein the second axial chamber comprises a circumferential inner sleeve insert constructed of pearlitic chrome ceramic to reduce metal to metal friction wear between the piston means and the second axial chamber circumferential and axially oriented sidewalls.

9. A piston suspension system according to claim 6 wherein the piston member is constructed of a material selected from the group consisting of aluminum, titanium, carbide, ferro-bonded carbide, tool steel, and combinations thereof.

10. A piston suspension system according to claim 6 wherein the piston member contact surface comprises a hardened annular ring insert constructed and arranged for contact with the second end of each of the pushrods.

11. A piston suspension system according to claim 6 wherein the biasing means comprises resilient urethane springs.

12. A piston suspension system according to claim 6 wherein the integral cylinder housing member comprises a debris evacuation bore having sidewalls extending substantially radially through a section of the cylinder housing first end portion sidewalls into the first axial chamber to provide a path for evacuating metallic debris, pressurized air, and coolant medium from within the first axial chamber.

13. A piston suspension system according to claim 6 wherein the piston member comprises sidewalls extending between the contact surface and the receiving surface, the sidewalls comprising ring grooves constructed and arranged for receipt of pressure retaining piston rings therein.

14. A piston suspension system according to claim 13 wherein the piston rings comprise chrome plated spring steel.

15. A piston suspension system according to claim 6 wherein the piston member receiving surface is a concave surface and the piston member contact surface is a substantially planar surface.

16. A piston suspension system according to claim 6 wherein the integral cylinder housing member second end portion sidewalls comprise oil inlet and drain means comprising an oil inlet bore and an oil drain bore each having sidewalls extending through the second axial chamber sidewalls to provide a metered oil inlet path and an oil drain path for lubricating oil to enter into and drain from the second axial chamber.

17. A piston suspension system according to claim 16 wherein the oil drain bore is located within a portion of the second axial chamber sidewalls proximate the integral chamber separator.

18. A piston suspension system according to claim 13 wherein the second axial chamber sidewalls comprise inner surfaces comprising:

(a) a circumferential and axially oriented inner sidewall surface constructed and arranged for operatively guiding axial movement of the piston member so that the piston member sidewalls remain in substantially parallel relation with the second axial chamber circumferential and axially oriented inner sidewall surface;

(b) a forward end surface formed by the integral chamber separator; and (c) corner surfaces extending between the circumferential and axially oriented inner sidewall surface and the forward end surface, the corner surfaces having a curved segment and linear segments, the linear segments forming a piston lock prevention groove extending radially into the circumferential and axially oriented inner sidewall surface so that the piston member contact surface and piston member sidewall surfaces will move toward and away from the second axial chamber forward end surface independent of any friction locking at the corner surfaces.

19. A piston suspension system according to claim 18 wherein the second axial chamber comprises a circumferential bumper located in the piston lock prevention groove and extending beyond the plane of the circumferential and axially oriented inner sidewall surface into the path of movement of the piston member to provide shock mitigation for the piston member and the second axial chamber corner surfaces.

20. A piston suspension system according to claim 19 wherein the circumferential bumper comprises durable urethane material.

21. A piston suspension system according to claim 18 wherein the intersection of the piston member sidewall surfaces and the piston member contact surface comprises a chamfered surface oriented approximately 45° relative to both the contact surface and the piston member sidewall surfaces, the chamfered surface providing means for preventing friction locking of the piston member during operation of the piston suspension system.

22. A piston suspension system according to claim 6 wherein the dome former set comprises a preload suspension of between about 2700 pounds and about 6000 pounds.

23. A piston suspension system according to claim 6 wherein the ring former set comprises a preload suspension of between about 600 pounds and about 1600 pounds.

24. A piston suspension system according to claim 6 wherein the nominal axial range of movement of the ring former set when contacted by a metal can blank is from 0 inch to about 0.500 inch.

25. A piston suspension system according to claim 6 wherein the nominal axial range of movement of the dome former set when contacted by a metal can blank is from 0 inch to about 0.008 inch.

26. A piston suspension system according to claim 6 further comprising stationary outer housing means for holding the integral cylinder housing member.

27. A method for absorbing the mechanical shock of a metal shaping machine during high speed and high throughput manufacture comprising the steps of:

(a) providing an integral cylinder housing member having first and second end portions, the first end portion comprising an elongate cylinder with sidewalls defining a first axial chamber with a first diameter, the second end portion comprising a cylinder with sidewalls defining a second axial chamber with a second diameter larger than the first diameter, the first and second axial chambers being separated by an integral chamber separator, the integral cylinder housing member first end portion sidewalls comprising a plurality of axially oriented bores extending from the cylinder housing member first end portion through the integral chamber separator into the second axial chamber;

(b) inserting a plurality of slidable pushrods into the integral cylinder housing member first end portion sidewall bores, each of the pushrods having a first end and a second end;

(c) mounting tool set means at the integral cylinder housing member first end portion, the tool set means comprising a ring former and a dome former for contacting and shaping a metal can blank, the ring former radially located around the dome former and in abutting engagement with the first end of each of the pushrods;

(d) configuring piston means to provide suspension for the pushrods, the piston means comprising a piston member movably positioned within the integral cylinder housing member second axial chamber, the piston member comprising a contact surface facing the integral chamber separator for contact with the second end of each of the pushrods extending through the integral chamber separator and a receiving surface substantially opposite the contact surface for receiving a pressurized medium; and (e) arranging a cover plate across the diameter of the second axial chamber and operatively biasing the cover plate axially against the integral cylinder housing member second end portion sidewalls;

(f) routing a pressurized medium into the second axial chamber to provide force against the piston member receiving surface so that as a metal blank is forced into contact with the tool set means the force of that contact is transferred through dual action of the ring former axially by the pushrods to the piston member and by the dome former substantially axially through the integral cylinder housing member sidewalls to the biased cover plate to permit high throughput metal shaping manufacture.

* * * * *

UNITED STATES PATENT AND TRADEMARK OFFICE

CERTIFICATE OF CORRECTION

PATENT NO. : 4,930,330

DATED : June 5, 1990

INVENTOR(S) : Gale Weishalla

It is certified that error appears in the above-identified patent and that said Letters Patent is hereby corrected as shown below:

Col. 7, Line 46

600 lbs should be "3600 Lbs"

Signed and Sealed this

Second Day of July, 1991

*Attest:*

*Attesting Officer*

HARRY F. MANBECK, JR.

*Commissioner of Patents and Trademarks*